United States Patent [19]

Stansbury, Jr.

[11] 4,246,666

[45] Jan. 27, 1981

[54] FLUSH TOILET

[76] Inventor: Benjamin H. Stansbury, Jr., 803 N. Doheny Dr., Beverly Hills, Calif. 90210

[21] Appl. No.: 961,516

[22] Filed: Nov. 17, 1978

Related U.S. Application Data

[63] Continuation-in-part of Ser. No. 813,842, Jul. 8, 1977, abandoned.

[51] Int. Cl.[3] ..... E03D 11/08; E03D 11/10; A47K 13/12; E05D 7/10

[52] U.S. Cl. ..... 4/438; 4/236; 4/440; 4/441; 16/173; 49/388

[58] Field of Search ..... 4/332, 340, 343, 350, 4/420, 429, 430, 431, 432, 433, 434, 435, 438–442, 236, 240, DIG. 8, 366; 49/382, 388, 389, 397; 16/173, 128 R

[56] References Cited

U.S. PATENT DOCUMENTS

| | | | |
|---|---|---|---|
| 270,980 | 1/1883 | Pike | 4/438 |
| 525,659 | 9/1894 | King | 4/440 X |
| 1,629,401 | 5/1927 | McCall | 4/439 |
| 2,204,704 | 6/1940 | Schumacher | 4/439 |
| 2,693,602 | 11/1954 | Meath | 16/173 |
| 2,763,871 | 9/1956 | Rutherford | 4/440 |
| 2,816,294 | 12/1957 | Duner | 4/439 |
| 3,798,681 | 3/1974 | Johansen | 4/440 |
| 3,883,903 | 5/1975 | Vanden Broek et al. | 4/440 |
| 3,939,500 | 2/1976 | Miller et al. | 4/442 X |

FOREIGN PATENT DOCUMENTS

| | | | |
|---|---|---|---|
| 653187 | 11/1962 | Canada | 4/236 |
| 463886 | 12/1913 | France | 4/439 |
| 1200475 | 6/1959 | France | 4/236 |

*Primary Examiner*—Stuart S. Levy
*Attorney, Agent, or Firm*—Donald D. Mon

[57] ABSTRACT

A flush toilet which includes a concave bowl with a bottom drain port and a closure such as a pan or plate to close the drain port. When a pan is used, it can hold a quantity of water to form a gas seal. When a plate is used, a mechanical seal is employed. The closure is pivotable away from the drain port to permit the bowl to drain. Flushing means is provided which includes a nozzle directing a stream of flushing water tangentially into the bowl, air purging means to purge air from said water stream before a substantial amount of it discharges into the bowl, and a unique combined ball valve and vacuum breaker in the water supply system. The toilet also can include linkage which toggle-locks the closure in its closed position, a break-way lid, and when a mechanical seal is used, a gas-sealing overflow.

22 Claims, 17 Drawing Figures

FLUSH TOILET

CROSS-REFERENCE TO CO-PENDING APPLICATION

This is a continuation-in-part of applicant's co-pending United States patent application, Ser. No. 813,842, filed July 8, 1977 now abandoned, entitled "Flush Toilet".

This invention relates to a flush toilet of the type wherein a pivoted closure closes or opens a drain port at the bottom of a bowl.

While flush toilets of the above type can be used anywhere that standard commodes are utilized, their principal application is for vehicles and for lighter weight structures because of their small size, light weight, and their adaptability to various types of water supplies.

Prior art flush toilets of this type have suffered from many inherent disadvantages which it is an objective of this invention to overcome. A principal one of the disadvantages is the tendency of the closure in response to vibrational or lateral forces to drop to the open position without flushing or actuation being intended. Also, when a water-filled pan is used for the closure, the water is sometimes slopped out of the pan even when the pan does not drop. Another disadvantage is uncertainty and insufficiency of washing of the wall of the bowl due to the entrainment of substantial amounts of air with the flushing water.

Still other disadvantages of the prior art reside in the complexity of their flushing valves and vacuum breakers and in rigid joinder of toilet lids and seats to the base structure.

It is the object of this invention to overcome all or any of the foregoing advantages in a compact, potentially light weight and attractive structure.

A flush toilet according to this invention includes a bowl having an upwardly-facing concavity with a drain port at the bottom thereof. A closure is pivotally mounted relative to the bowl where it can assume a closed and an open position relative to the drain port. When a pan is used, it can hold a quantity of water when in the closed position which makes a gas seal at the drain port. When a plate is used, a mechanical seal can be provided. Linkage means is provided to move the closure from one position to the other. A water inlet conduit is connectable to a water supply and flows through a valve, a vacuum breaker, and nozzle means, to discharge water into the bowl.

According to a preferred but optional feature of the invention, the nozzle means includes a nozzle orifice, and upstream from the nozzle means there is a weir having a passageway over its top through which first air and then water can flow, thereby substantially to purge air from the system before substantial water flows through the nozzle orifice.

According to still another preferred but optional feature of the invention, a side passageway is provided at the weir to enable water behind the weir to drain into the bowl after the water pressure is shut off to provide water for the gas seal.

According to still another preferred but optional feature of the invention, the valve and the vacuum breaker are integral with one another.

According to still another preferred but optional feature of the invention, the lid is able to snap off without damage to the lid or to its support.

According to yet another feature of the invention, a gas-sealing overflow can be provided when a mechanical seal is used at the drain port.

The above and other features of this invention will be fully understood from the following description and the accompanying drawings, in which.

Figure 5:
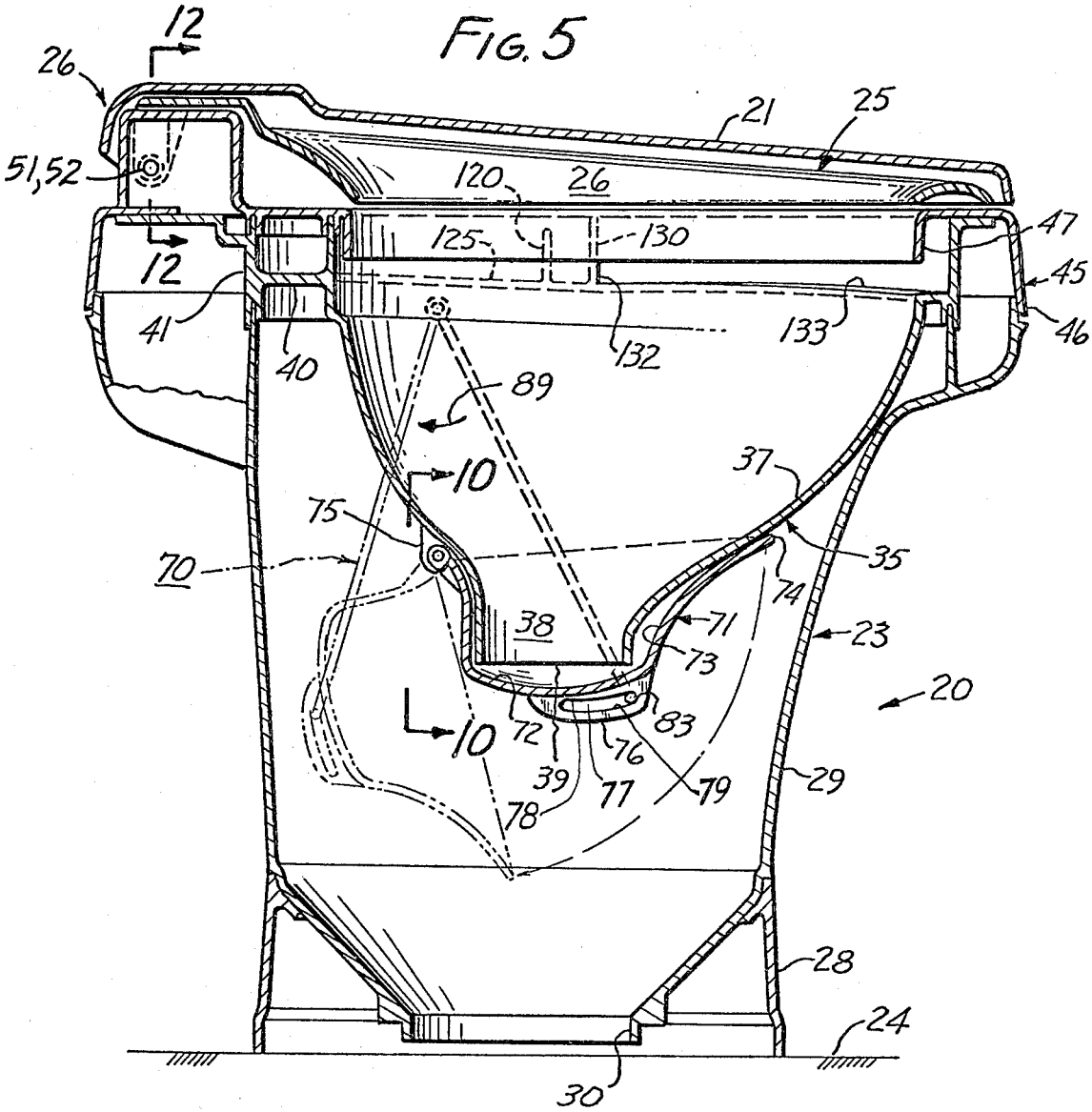
FIG. 5 is a cross-section taken at line 5—5 in FIG. 2.
Figure 10:
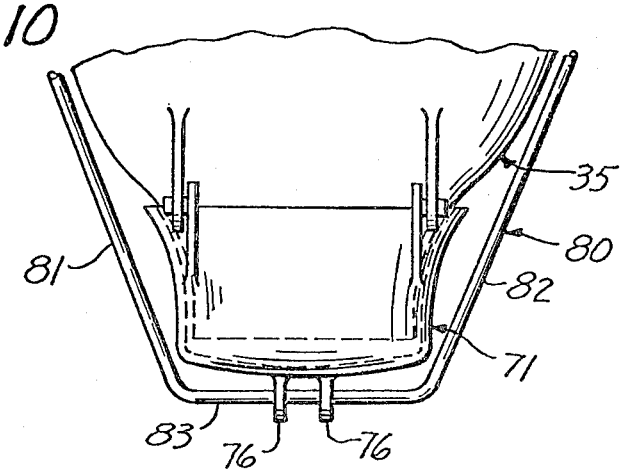
Figure 6:
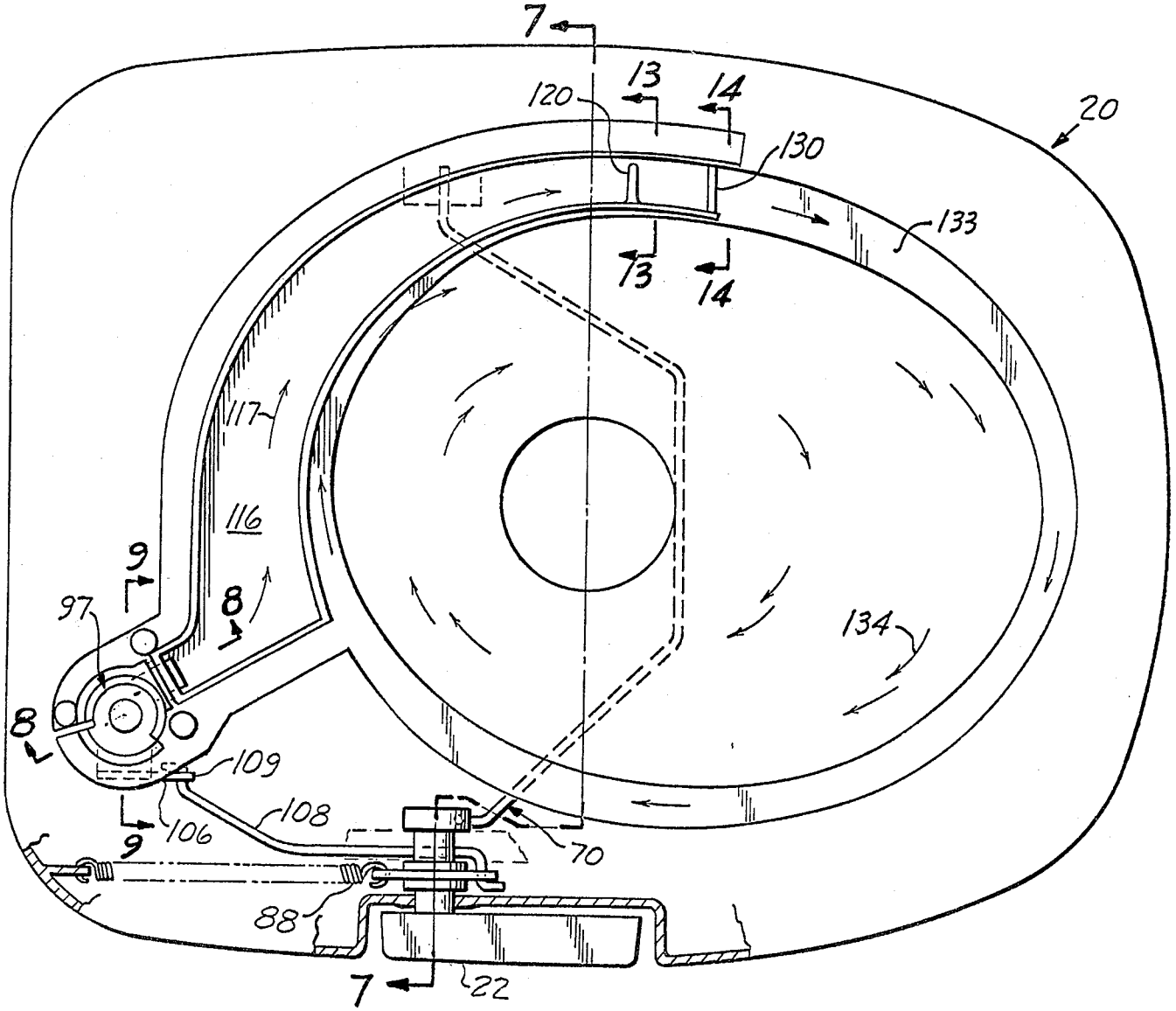
FIG. 6 is a cross-section taken at line 6—6 in FIG. 3.
Figure 11:
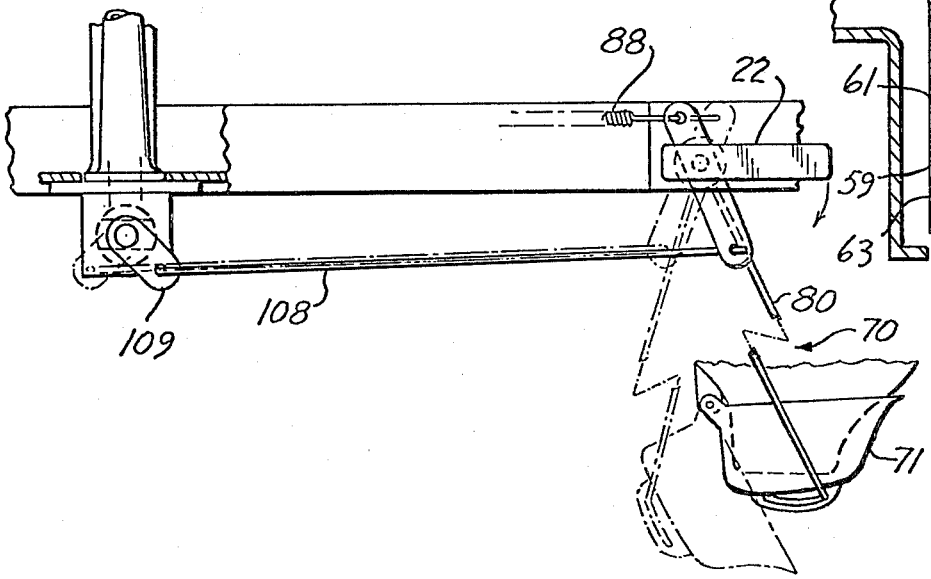
Figure 12:
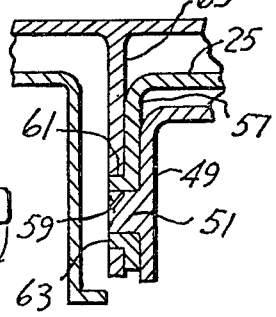
Figure 8:
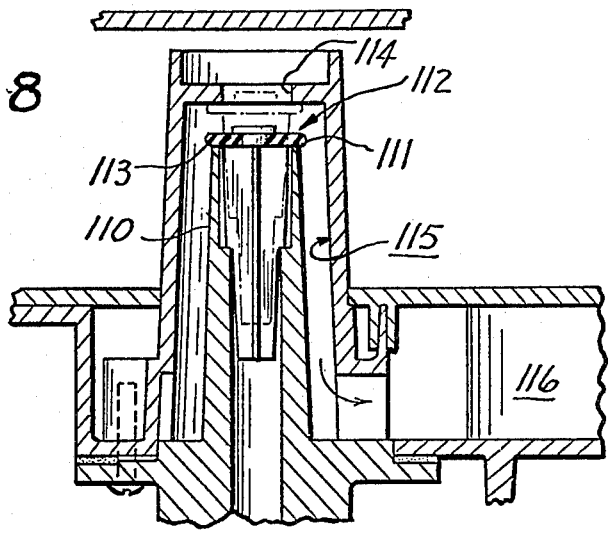
Figure 9:
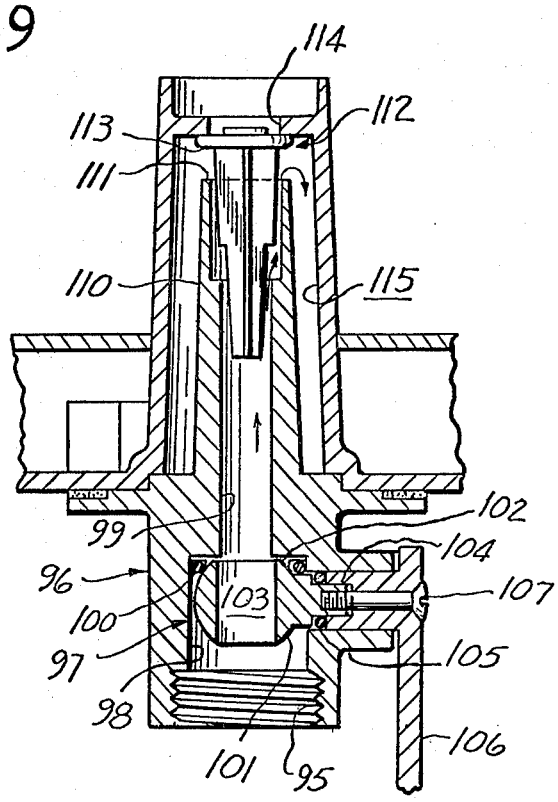
Figure 13:
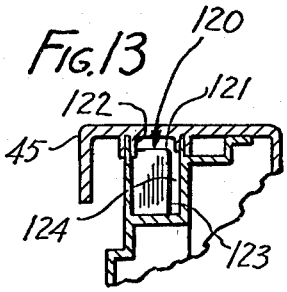
Figure 14:
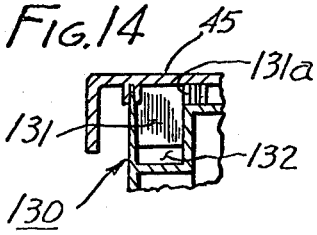
Figure 15:
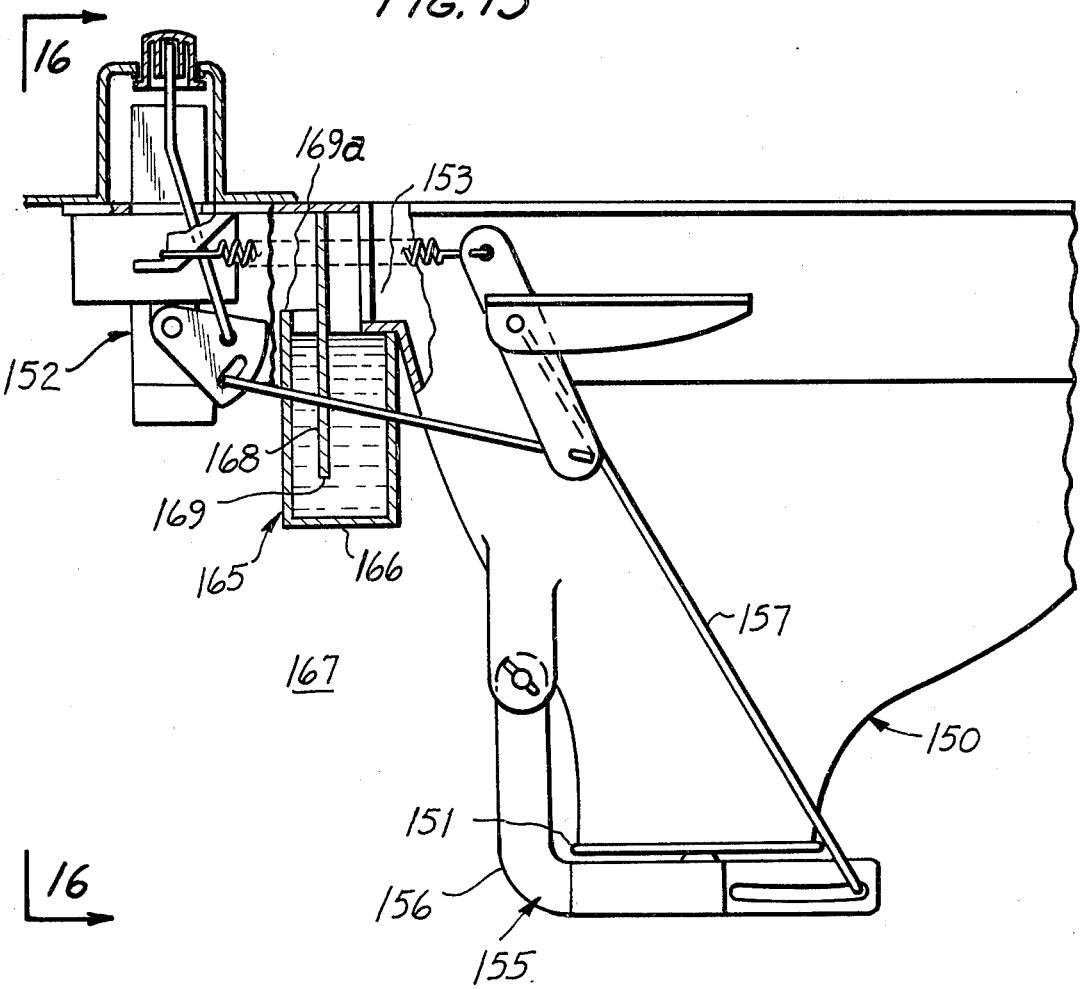
Figure 16:
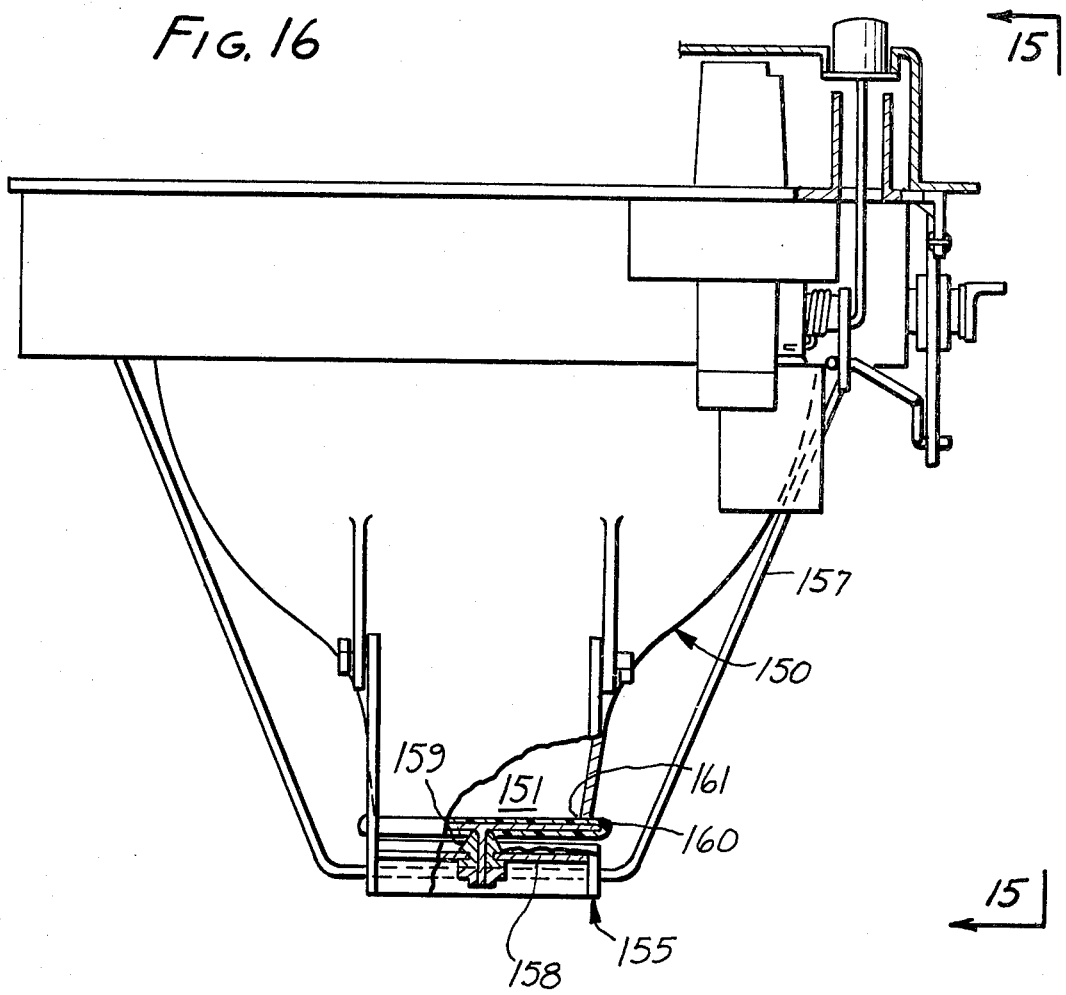

FIGS. 8 and 9 are cross-sections taken at lines 8—8 and 9—9; respectively, in FIG. 6;

FIG. 10 is a fragmentary view taken at line 10—10 in FIG. 5;

FIG. 11 is a fragmentary view showing various positions of the flushing linkage line;

FIG. 12 is a fragmentary cross-section showing a detail of lid attachment means;

FIGS. 13 and 14 are cross-sections taken at lines 13—13 and 14—14, respectively in FIG. 6;

FIG. 15 is a side view, partly in cutaway cross-section, showing a modification of the invention;

FIG. 16 is a left-hand side view in FIG. 15; and

Figure 17:
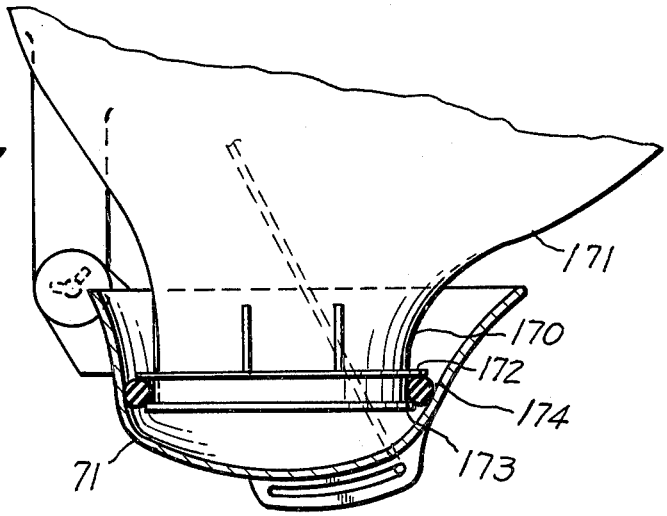

FIG. 17 is a fragmentary view, partly in cutaway cross-section, showing still another modification of the invention.

Figure 1:
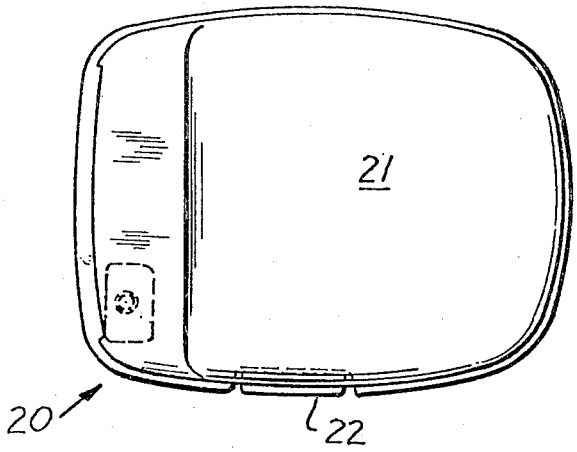
FIG. 1 is a top view of the presently preferred embodiment of the invention.
Figure 2:
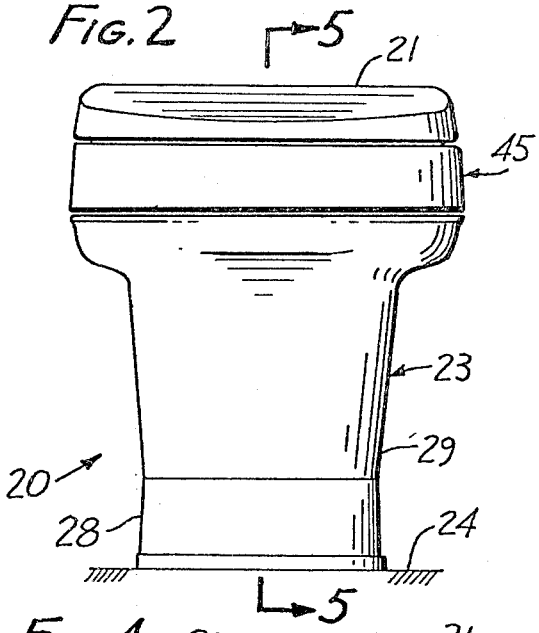
FIG. 2 is a front view of the structure of FIG. 1.

The presently preferred embodiment of flush toilet 20 according to the invention shown in the drawings. FIG. 1 shows its top configuration, with a lid 21 and at one side a flushing lever 22. FIG. 2 shows its standard 23. The standard is the basic support, and has an outer boundary. The toilet rests on a base 24 which might be the floor of a vehicle. The standard rises to a seat 25 which the lid rests upon when closed.

Figure 3:
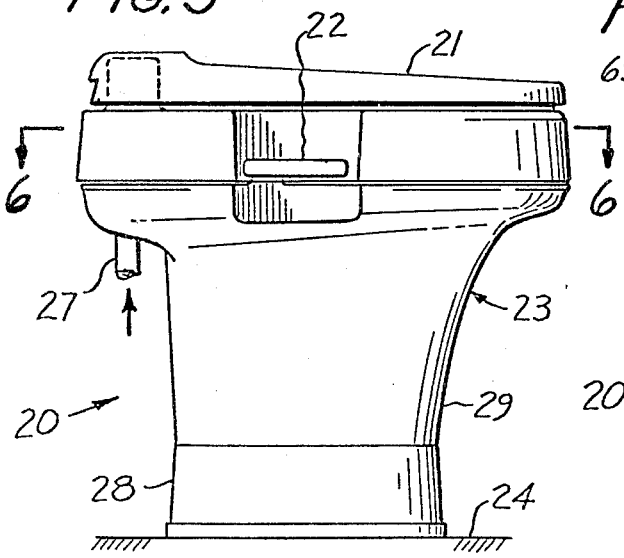
FIG. 3 is a left-hand view of FIG. 2.
Figure 4:
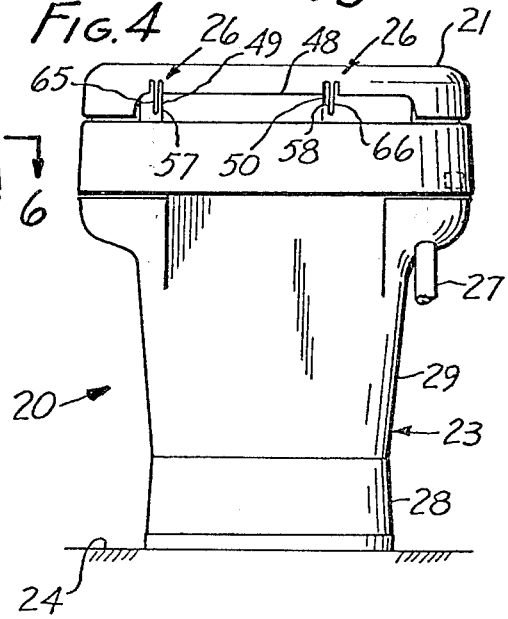
FIG. 4 is a left-hand view of FIG. 3.

Hinge means 26 (FIGS. 3, 4 and 12) are shown which hinge the lid to the seat. A water supply line 27, such as a pipe or a hose, is connected to any desired water supply. When the toilet is to be used the lid is tilted upwardly whereby to expose the seat and internal parts which are yet to be described.

More particularly with regard to FIG. 5, the standard includes a base member 28 which rests on base 24 and a shroud 29 supported by the base member. The shroud includes a central opening 30 which discharges into a holding tank or sewer as appropriate. The shroud includes a continuous peripheral gas-tight wall. A bowl 35 is located and supported inside the standard. It forms a concavity 36 which faces upwardly and generally tapers toward the bottom. It has a continuous inner wall 37 and a drain port 38 at a lower margin 39 of the bowl. The bowl is supported by a continuous peripheral web 40 that in turn is held by a support ring 41. The support ring rests atop shroud 29 in a tongue-and-groove relationship, whereby to form a gas seal around the standard. Sealants may be placed at all junctions shown, although this will often be unnecessary when the device is suitably cemented or heat-fused, or solvent-welded together.

Support ring 41 rises upwardly to support a top member 45 which rests on the support ring and has a depending flange 46, making contact with a forward portion of the shroud and a depending internal lip 47 facing downwardly toward the bowl. The foregoing constitutes the structural parts of the toilet which primarily bear the weight of the user.

The top member includes an elevated portion 48 having a pair of sidewalls 49 and 50 (FIG. 4) which forms a side support for respective studs 51 and 52. See detail in FIG. 12, where sidewall 49 is shown. Sidewall 50 is identical but faces oppositely therefore only the structure for one side is described in detail.

A conventional seat 25 includes a seat portion 56 for the user to sit upon and a pair of mounting flanges 57, 58, each of which has an opening (opening 59, for example, in FIG. 12), and a stud, (stud 61, for example, in FIG. 12) respectively. The openings receive stud 51 or 52 and stud 61 projects laterally into a respective opening 63 in a flange 65 on the lid. This structure is duplicated on the other side. Conveniently, the studs or the walls of the openings can be tapered or chamfered to a small degree so that when sufficient lateral force is exerted either on the seat or on the lid, the flanges will readily deflect and the flanges will snap off of the studs so that the lid or seat or both can come off without damage to themselves or to the supporting structure.

Linkage means 70 is provided to move a pair 71 ("closure") between the two positions shown in FIG. 5. The uppermost pan position shown in the solid line is called the "closed position" and the lower pan position shown in dashed line is called the "open position". Pan 71 includes a bottom 72 and a peripheral sidewall 73. The sidewall is preferably rather steeply sloped as shown, and has an upper margin 74 which when the pan is in its closed position makes a relatively close approach to the outer wall of the bowl structure. The pan can be mounted to any fixed structure but preferably is mounted to a hinge plate 75 which itself is mounted to the outside of the bowl.

Figure 7:
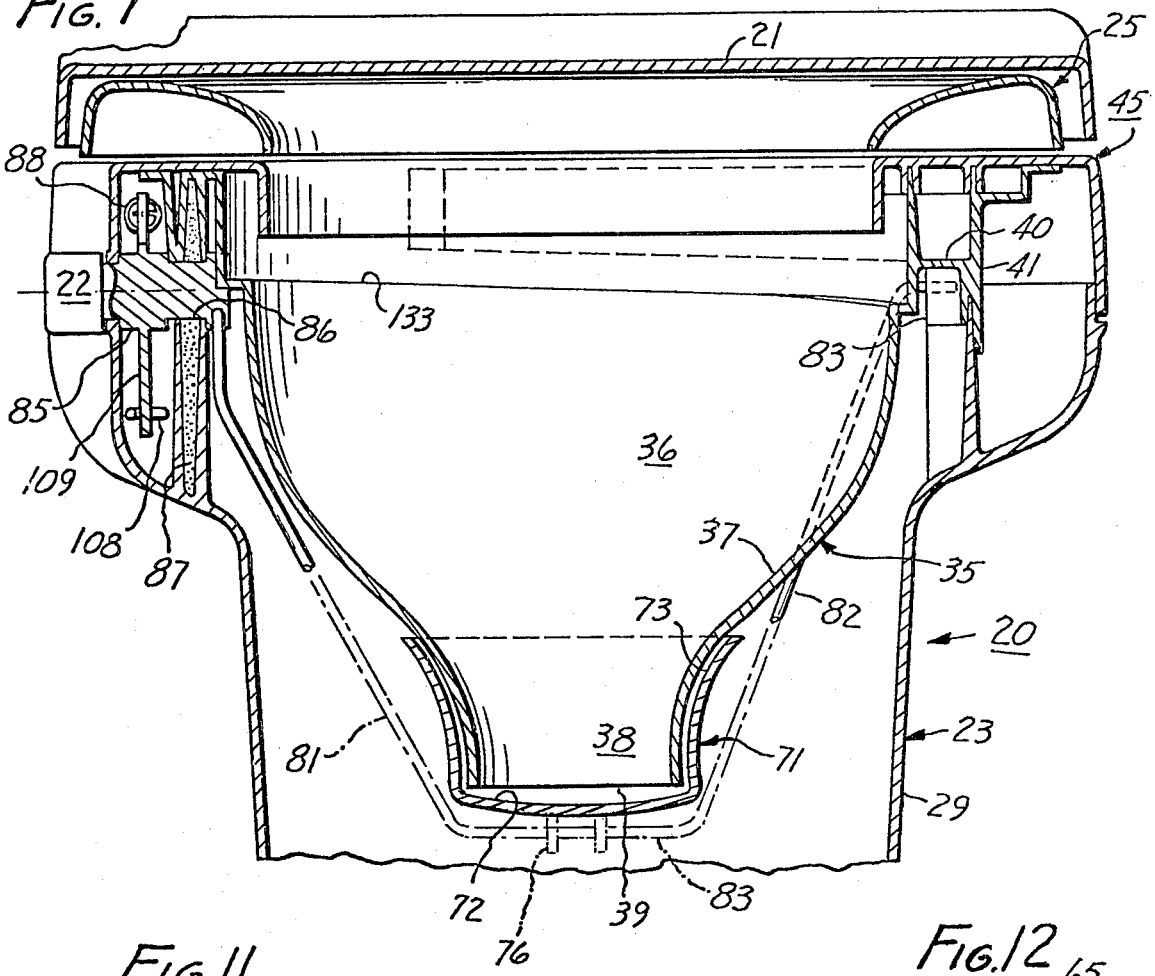
FIG. 7 is a cross-section taken along line 7—7 in FIG. 6.

The linkage means includes lever plate 76 on the bottom of the pan which includes a slot 77 having walls 78, 79 that form part of a toggle system yet to be described. The linkage means also includes a bail which comprises a pair of swing arms 81, 82, connected by bight 83 (FIG. 7). Bight 83 passes through slot 77. Preferably there are two lever plates 76, as best shown in FIG. 7.

Swing arm 82 is pivotally mounted in bearing 84 in the standard, while swing arm 81 is mounted to a shaft 85 which is in turn rotatably mounted in a bearing 86. A gasket 87 provides a gas seal around this bearing. The handle is attached to the shaft on the outside of the standard. A bias spring 88 biases the linkage toward the closed position. The bail is a stiff rod-like structure with substantial resistence to bending. Turning the shaft 85 by pushing on the handle against the bias of spring 88 will cause rotation of the bail in the direction shown by arrow 89 (in FIG. 5) to move the pan to its open position. This movement will be assisted by the weight of the pan itself and of the water contained therein. As seen in FIG. 5, there will have been movement of the bight along the length of the slot in the course of this motion.

Now with reference to FIGS. 8 and 9, water line 27 connects to a threaded fitting 95 in a body 96 of flushing valve 97. The flushing valve is a ball valve and includes an inlet 98 and an outlet 99. The inlet is connected to the water supply at fitting 95. A seal 100 is seated in the valve, against which a rotatable ball 101 having an outside sealing surface 102 bears while it rotates. A passage 103 extends laterally through the ball, and can be rotated to one position (FIG. 9) to make a fluid passage from inlet to outlet, or can be rotated 90° to another position to prevent flow through the valve according to known ball valve constructions.

The ball has a neck 104 which passes through an O-ring seal 105 and is engaged by an operating lever 106, which is held to the neck by a screw 107. Turning this lever will turn the ball around its axis. Passage 103 is normal to this axis. In turn, this lever (see FIGS. 6 and 11) is connected to a link 108 that is mounted to an ear 109 rotated by shaft 85. Therefore, in at least some rotational positions of the shaft the valve will be open to flow and in others it will be closed to flow. The bias spring 88 biases the valve to its closed position because of the bias it exerts on the shaft. The flushing valve is closed when the pan is in its closed position.

Body 96 rises to form a tube 110 with a seat 111 at its upper end. A poppet 112 is slidably fitted in the upper end of the tube and carries a seal 113 which, when the poppet rests on the seat closes the same. Sufficient pressure inside the tube will move the poppet up off of its seat and against a vent port 114 formed in the wall of water inlet conduit 115. Therefore, the poppet has two alternative sealing functions, one is to seal the tube against back flow into the water supply when the water pressure is not on or is negative, and the other is to close the vent port 114 when the water pressure is on and water is flowing through the flushing valve. The purpose for this will become apparent.

The unitary ball valve and vacuum breaker are installed in a portion of the water inlet conduit between the water supply and other means yet to be described. The said conduit is defined as including the inlet to the flushing valve. The water inlet conduit includes an enlarged channel 116 (see FIGS. 6 and 8) which receives water under pressure from the flushing valve and vacuum breaker. The water flows in the direction of arrows 117 through channel 116 which channel gradually decreases in cross-section. The top of this channel is formed by the top member 45. Its bottom is formed by the support ring 41. This channel curves around past the outer periphery of the bowl structure. Water flowing therein first encounters a weir 120, which as best shown in FIGS. 5, 6 and 13, includes a top edge 121 leaving a flow passage 122 over the top of the weir, and a side edge 123 leaving a flow passage 124 at the side of the weir. Flow passage 124 rises from the bottom 125 of channel 116 and flow passage 122 is spaced well above it. Because of the presence and functions of weir 120, channel 116 becomes a reservoir, as will later be described.

Nozzle means 130 is located downstream from the weir. The nozzle means includes a nozzle plate 131 forming a nozzle orifice 132. A small bleed port **131*a* at the top of the plate assists the drainage after the pressure is off, without diverting much water from the main stream. This nozzle surface is directed tangentially into the bowl, onto a ledge 133 which extends around the top of the bowl. Also the ledge slopes toward the bowl. This will dispense water in a generally spiral pattern onto the bowl wall as shown by arrows 134**, to wash an optimum portion, preferably all, of the wall of the bowl. Providing the water supply in a strong substantially air-free stream results in a good distribution of water around the entire periphery of the ledge and of the bowl, because the stream tends to remain quite coherent.

As a consequence of this spiral flow, and also of the fact that the forward portion 135 of the bowl slopes rather gradually toward the rear, there is a substantial flow of water from the bowl which discharges backwardly onto the pan in its open position. This is another advantage of the swirling flow provided by the nozzle means. Cleaning of the pan has been a problem in prior art devices.

As is evident from the foregoing, the seat and the lid overlay the top member, and can be raised around their own hinge means as necessary and appropriate. The sealing means for preventing sewer gas from escaping into the room is formed by the standard and by the water seal in the pan when the pan is closed.

FIG. 15 shows a modification of the invention. Its basic structure is identical to that shown in FIGS. 1–14, and will not be described again. Bowl 150 has a drain port 151 at its lower end, and water control, and water discharge features as already described. Also there are a water valve 152, and a channel 153 both as described above.

However, closure 155, instead of being a pan, is plate-like. It includes a pivoted support arm 156 that is controlled by linkage means 157 similar to that which already has been described. The closure includes a base 158, and a gimbal-like mount 159 for a disc-like seal mount 160 which can be moved toward and away from the lower edge 161 of the drain port. It carries a resilient seal. The seal is therefore universally tiltable so as readily to move into full contact with the drain port. The seal can be disc or a ring as desired. When in the closed position shown in FIGS. 15 and 16, the closure closes the drain port. It can be swung away from the drain port to open the same. It preferably will be washed clean by water discharged from the drain port.

In the embodiment of FIGS. 1–14, should the water valve be stuck open, the excess water will simply flow into the outer structure and out to drain, by flowing over the lip of the pan. There is no mechanical obstruction. However, in FIGS. 15 and 16, such water could not escape past the closure. Therefore, a gas-sealing overflow means 165 is provided somewhere near the top of the bowl. This may conveniently be located at the channel 153.

Means 165 comprises a container 166 connected to the channel on one side, and to region 167 outside the bowl, but inside the standard, on the other, thereby by-passing the drain port. A depending barrier 168 dips into the container to form a U-shaped flow path and a gas barrier. Now overflow water can flow into the container, under lower edge 169 of the barrier, and over lip 169*a* of the container, and to sewer.

FIG. 17 shows that the construction of FIGS. 1–14 can be adapted also or instead to use a mechanical seal. Here the lower end 170 of bowl 171 has a pair of support shoulders 172, 173 which trap an O-ring 174 that can bear against pan 71 to make a seal. In such an event, an overflow means such as means 165 should be provided, because excessive water can no longer flow over the lip of the pan.

The operation of the devices will now be described. The system is connected to a sewer or to a holding tank and to a supply of water. In FIGS. 1–14, the pan will start in its closed position as a consequence of the spring bias. To flush the system, the lever is pressed to turn shaft 85 around its axis, thereby to swing the bail from the right-hand position in FIG. 5 to the left-hand position, and to open the flushing valve. The bail will tilt the pan to the open position as a consequence of its camming action on the slot wall. It is assisted by the weight of the pan. This movement is opposed by the spring bias, which is overcome.

When the handle is released, the spring bias will return the pan to the closed position where the interaction between the slot and the bight is one of a toggle action, i.e., wherein the weight of the pan does not tend to cam the bail toward the left-hand position. This is merely a matter of selecting the appropriate angularity of the slot relative to the centers of rotation of the pan and of the bail. Because of the length of the slot and the relative locations of the pivot, there is no "jam" point at which relative motion is impossible when the shaft is turned. Thus, while the device can readily be operated by driving the bail by turning the shaft, the bail cannot be driven by the pan. It will be understood, of course, that a toggle relationship is not essential to the invention. Instead, reliance for closure may be had strictly on the spring bias. Also reliance can be had strictly on the toggle without a spring bias, but this requires effort to stop the function, and is not preferred. The toggle relationship does assist in preventing the pan from rattling and from being jarred loose to its open position by excessive vibration, as has occurred with some previously known toilets. Therefore, the toggle relationship is not an essential limitation on this invention, but is a preferred advantage. If the spring should break, the toggle will hold the pan closed and permit the flushing valve to be closed.

When the shaft is turned to open the drain port, it also opens the ball valve to pass water to the water inlet conduit 115. This conduit extends, by definition, from the inlet of the ball valve to the outlet of the nozzle means. Water first raises the poppet upwardly to force it against the vent port to close it, then flows downwardly around the tube and into channel 116. The channel is initially filled with air. Unless this air is purged, water will not emerge as a coherent air-free stream, and it will have far less reliability for distribution and for washing the bowl wall. This is a disadvantage of the prior art.

It is a purpose of the weir first to purge the air from the system and then discharge substantially air-free water under strong pressure. The weir does permit some water to escape past its side passageway along with the air, but because of its dimensions, it tends to permit air to flow out very quickly, and restrains much of the water flow until after the air is purged from chamber 116 and begins to flow over the weir. The amount which flows over the weir is greater than that which flows through the side passage during the air purging event. Therefore, as soon as the air is purged, the chamber 116 is full of water at full system pressure and this water flows through the passageways at a rapid rate and into the nozzle chamber. The nozzle chamber is relatively small in volume so that if its air is not thoroughly purged, it has little effect on the stream.

The water discharges through the nozzle orifice tangentially to the surface of the ledge under full system pressure so long as the flushing valve is held open. It will be open so long as the pan is held down and the user sees the need for further flushing water. When this term expires, the handle is released, and the pan is returned to its closed position by the bias means. If toggle means is used, the pan is locked in the closed position by the toggle action. At this time, however, there remains a chamber full of water in chamber 116. This water is no longer under full system pressure because with the closure of the ball valve, the poppet drops to close the tube, and vents chamber 116, which now is only under atmospheric pressure. This immediately cuts the rate of flow past the weir and the water gradually flows, in on particular rush, through the side passage, through the nozzle means, and drains slowly into the bowl where it forms the necessary gas seal in the pan. The walls of the pan are relatively steeply sloped so that a relatively small volume of water gives a relatively high seal, which will not readily slosh out as a consequence of lateral movement of the structure. Also the close fit between the pan and the outside of the bowl assists in retention of water, but it should still have enough clearance to enable overflow from the pan if the flushing valve should leak.

The dimensions of the weir and its passages will be selected with regard to the expected system pressure and the flow rates. In one successful device wherein the system pressure is about 15 psi, the section at the weir is about 1 inch wide and $1\frac{1}{2}$ inches tall, the weir about 7/8 inches wide and $\frac{3}{4}$ inches tall, located at a lower corner of the section. The nozzle means is about $1\frac{1}{2}$ inches downstream from the weir, and its orifice is about 1 inch wide and $\frac{1}{4}$ inches tall.

To repeat the cycle, the handle is again depressed and the events will be repeated.

The devices of FIGS. 15–17 function the same as that of FIGS. 1–14, except that their closures make a mechanical seal which prevents excess water from flowing over the upper edge of the pan to prevent flooding. Instead, when the bowl is overfilled, excess water flows into the container, under the partition and over the upper edge of the container, into the standard and out the sewer.

Instead of the flexible seal's being carried by the closure it is obvious that it can be applied to the bottom of the bowl, and a flat plate brought against it. In any event, something should "float" so as to make a reliable seal. In FIG. 16 this is the seal itself. If a plate were to be brought against a seal, then the plate should float.

In every case described herein, a gas tight seal is made by the closure.

The term "connected" as used herein to describe the operational relationship between the linkage means and the pan, is not limited to direct attachments. It might instead be an abutment wherein the bail or other swingable member simply bears against the closure or against flanges on the closure.

In the event a user opens the seat and lid beyond normal use position, both the lid and the seat are readily detachable and snap loose by simply coming off of their associated studs. This prevents breakage of the underlying structure.

This invention thereby provides an elegant and simple flushing system for a toilet which gives an optimum washing down of the bowl, which tends to retain the gas seal, even in the presence of substantial vibration and lateral movement, which is readily manufactured from cast parts, and which gets best flushing advantage from a relatively minimal quantity of water.

This invention is not to be limited by the embodiments shown in the drawings and described in the description which are given by way of example and not of limitation but only in accordance with the scope of the appended claims.

I claim:

1. A flush toilet comprising: a bowl having an inner wall with an upper rim and a bottom drain port, said drain port having a lower margin, said wall tapering generally inwardly and downwardly so as to form an upwardly facing concavity; a closure comprising a pan beneath the drain port at the outside of the bowl, said pan having a bottom and an upwardly extending peripheral wall with an upper margin, said pan being pivotally mounted relative to the bowl by pivot means which is located sidewardly relative to the lower margin of the drain port so that said pan is swingable to an upper substantially horizontal closed position beneath the drain port where its upper margin stands above the lower margin of the drain port whereby sufficient water in the pan will form a gas seal at the drain port, and is also swingable to a tilted open position wherein the pan is removed from the drain port to permit drainage therethrough and part of it is disposed below the elevation of said drain port in the path of a substantial portion of the water flowing out of the drain port whereby to be rinsed by said water, said pan being shaped so that substantially all water drains from it while in said open position; linkage means pivotally mounted relative to the bowl and connected to the pan to swing the pan to its said positions; and flushing means comprising a water inlet conduit connectible to a supply of water under pressure a flushing valve and a vacuum breaker connected in said inlet conduit, and nozzle means receiving water passed by the said valve and vacuum breaker discharging said water into the bowl to flush the same, said linkage means also being connected to said valve to open said valve for at least some of the time the pan is away from its closed position, said linkage means comprising a pivoted rigid member mounted relative to the bowl and having a swingable portion, a lever plate fixed to the pan, said lever plate having a slot receiving the swingable portion the slot and the member being so disposed and arranged that the pan can tilt downwardly over a portion of the arcuate movement of the swingable portion, but is held in its closed position at another arcuate position of the member.

2. A flush toilet according to claim 1 in which the member is springloaded toward the said closed position.

3. A flush toilet according to claim 2 in which a handle is attached to the member to rotate the rigid member, and in which said handle is also attached to the valve.

4. A flush toilet according to claim 1 in which said member is a bail having two pivoted swingable members connected by a bight, said bight fitting in said slot, and said bail being rigid, and in which said bight and said slot are so disposed and arranged relative to one another, and to the centers of rotation of the pan and of the bail, that in said closed position the bail and the lever plate act as a toggle to hold the pan in its closed position until the bail is swung to another angular position.

5. A flush toilet according to claim 1 in which said member and said slot are disposed and arranged relative to one another, and to the centers of rotation of the pan and of the member, that in said closed position the member and lever plate act as a toggle to hold the pan in its closed position until the member is swung to another angular position.

6. A flush toilet according to claim 5 in which said nozzle means comprises a nozzle chamber and a nozzle orifice at the downstream end of the nozzle chamber, and in which air purging means is disposed between said nozzle chamber and the valve, said air purging means comprising a weir in the water inlet conduit rising from the bottom thereof and leaving a flow space above the weir over which air and water can flow to the nozzle chamber.

7. A flush toilet according to claim 6 in which said valve and said vacuum breaker comprises a unitary construction, said valve including a body having an inlet, an outlet, a peripheral seal around the outlet, a rotatable ball having an external sealing surface and a flow passage, said ball being rotatably mounted in said valve body whereby to close said outlet or to connect it to said inlet through the passage as determined by the rotational position of the ball, a vertical tube above and in fluid connection with said outlet and formed as part of said body, a seat on said tube, a poppet having a seal, said poppet being slidably supported in said tube so as normally to close the same by applying the seal to the seat, but to be movable to open the same by sufficient fluid pressure exerted in said tube, a vent port in the wall of the water inlet conduit, said poppet closing the said vent port when moved to open the tube, and opening the vent port when closing the tube.

8. A flush toilet according to claim 7 in which the ball is linked to linkage means to be rotated thereby.

9. A flush toilet according to claim 6 in which said weir forms an upwardly extending passageway having such dimensions as to limit the rate of water flow therethrough, whereby after the valve is closed, water remaining in the water inlet conduit upstream from the weir can flow at a lesser rate through said passageway to provide water for the said gas seal after the pan is closed.

10. A flush toilet according to claim 9 in which said member is a bail having two pivoted swingable members connected by a bight, said bight fitting in said slot, and said bail being rigid, and in which said bight and said slot are so disposed and arranged relative to one another, and to the centers of rotation of the pan and of the bail, that in said closed position the bail and the lever plate act as a toggle to hold the pan in its closed position until the bail is swung to another angular position.

11. A flush toilet according to claim 10 in which a relatively small bleed hole discharges from the nozzle chamber at an elevation above the nozzle orifice.

12. A flush toilet according to claim 10 in which the water inlet conduit includes an enlarged portion upstream from the weir to provide said water for the bowl after the drain port is closed.

13. A flush toilet comprising: a bowl having an inner wall with an upper rim and a bottom drain port, said drain port having a lower margin, said wall tapering generally inwardly and downwardly so as to form an upwardly facing concavity; a closure comprising a pan beneath the drain port at the outside of the bowl, said pan having a bottom and an upwardly extending peripheral wall with an upper margin, said pan being pivotally mounted relative to the bowl by pivot means which is located sidewardly relative to the lower margin of the drain port so that said pan is swingable to an upper substantially horizontal closed position beneath the drain port where its upper margin stands above the lower margin of the drain port whereby sufficient water in the pan will form a gas seal at the drain port, and is also swingable to a tilted open position wherein the pan is removed from the drain port to permit drainage therethrough and part of it is disposed below the elevation of said drain port in the path of a substantial portion of the water flowing out of the drain port whereby to be rinsed by said water, said pan being shaped so that substantially all water drains from it while in said open position; linkage means pivotally mounted relative to the bowl and connected to the pan to swing the pan to its said positions; and flushing means comprising a water inlet conduit connectible to a supply of water under pressure a flushing valve and a vacuum breaker connected in said inlet conduit, and nozzle means receiving water passed by the said valve and vacuum breaker discharging said water into the bowl to flush the same, said linkage means also being connected to said valve to open said valve for at least some of the time the pan is away from its closed position, said nozzle means comprising a nozzle chamber and a nozzle orifice at the downstream end of the nozzle chamber, and in which air purging means is disposed between said nozzle chamber and the valve, said air purging means comprising a weir in the water inlet conduit rising from the bottom thereof and leaving a flow space above the weir over which air and water can flow to the nozzle chamber.

14. A flush toilet according to claim 13 in which said wier forms an upwardly extending passageway having such dimensions as to limit the rate of water flow therethrough, whereby after the valve is closed, water remaining in the water inlet conduit upstream from the weir can flow at a lesser rate through said passageway to provide water for the said gas seal after the pan is closed.

15. A flush toilet according to claim 14 in which the water inlet conduit includes an enlarged portion upstream from the weir to provide water for said gas seal.

16. A flush toilet according to claim 14 in which said nozzle means discharges water tangentially to the bowl.

17. A flush toilet according to claim 16 in which the bowl includes a peripheral ledge around the said rim, which ledge decreases in width as it extends away from said nozzle means.

18. A flush toilet according to claim 14 in which a relatively small bleed hole discharges from the nozzle chamber at an elevation above the nozzle orifice.

19. A flush toilet according to claim 14 in which said nozzle means discharged water tangentially to the bowl.

20. A flush toilet according to claim 19 in which the bowl includes a peripheral ledge around the said rim, which ledge decreases in width as it extends away from said nozzle means.

21. A flush toilet comprising: a bowl having an inner wall with an upper rim and a bottom drain port, said drain port having a lower margin, said wall tapering generally inwardly and downwardly so as to form an upwardly facing concavity; a closure comprising a pan beneath the drain port at the outside of the bowl, said pan having a bottom and an upwardly extending peripheral wall with an upper margin, said pan being pivotally mounted relative to the bowl by pivot means which is located sidewardly relative to the lower margin of the drain port so that said pan is swingable to an upper substantially horizontal closed position beneath the drain port where its upper margin stands above the lower margin of the drain port whereby sufficient water in the pan will form a gas seal at the drain port, and is also swingable to a tilted open position wherein the pan is removed from the drain port to permit drainage therethrough and part of it is disposed below the elevation of said drain port in the path of a substantial portion of the water flowing out of the drain port whereby to be rinsed by said water, said pan being shaped so that substantially all water drains from it while in said open position; linkage means pivotally mounted relative to the bowl and connected to the pan to swing the pan to its said positions; and flushing means comprising a water inlet conduit connectible to a supply of water under pressure a flushing valve and a vacuum breaker connected in said inlet conduit, and nozzle means receiving water passed by the said valve and vacuum breaker discharging said water into the bowl to flush the same, said linkage means also being connected to said valve to open said valve for at least some of the time the pan is away from its closed position; a seat pivotally mounted relative to the bowl; a lid pivotally mounted to the seat; hinge means pivotally mounting the lid to the seat, said hinge means having a hinge axis, and being laterally separable by sufficient force without fracture whereby the lid is removable from the seat, said hinge means comprising a stud on the seat, and a stiffly flexible flange on the lid with an opening therein, said flange being adapted to bend and to snap the opening over the stud to form the hinge, said sufficient force removing the flange from the stud.

22. A flush toilet according to claim 21 in which one of said stud and opening has a tapered surface to assist the said separation.

* * * * *